United States Patent [19]

Yung

[11] Patent Number: 4,655,023

[45] Date of Patent: Apr. 7, 1987

[54] SPACER FOR CONSTRUCTION USE

[76] Inventor: Fernand P. Yung, 927 S. Laurel St., Santa Ana, Calif. 92704

[21] Appl. No.: 693,977

[22] Filed: Jan. 23, 1985

[51] Int. Cl.[4] ..... F04C 5/16

[52] U.S. Cl. ..... 52/685; 52/687; 52/689; 248/74.4

[58] Field of Search ..... 52/677–689, 52/719; 248/74.3, 74.4, 74.1, 505, 221.4

[56] References Cited

U.S. PATENT DOCUMENTS

| | | | |
|---|---|---|---|
| 1,631,787 | 6/1927 | Bennett | 52/677 X |
| 3,209,509 | 10/1965 | O'Callaghan, Jr. | 52/688 |
| 3,300,930 | 1/1967 | Weise | 52/677 X |
| 3,348,347 | 10/1967 | Berry | 52/684 X |
| 3,387,423 | 1/1968 | Andersen | 52/678 |
| 3,694,989 | 10/1972 | Oliver et al. | 52/687 X |
| 3,830,032 | 8/1974 | Robb | 52/687 |
| 4,033,534 | 7/1977 | Bergkuist | 52/689 X |
| 4,060,954 | 12/1977 | Liuzza | 52/678 |
| 4,147,008 | 4/1979 | Eisner | 52/684 |
| 4,395,009 | 7/1983 | Bormke | 248/74.4 |
| 4,498,270 | 2/1985 | Ilukowicz | 52/685 |

FOREIGN PATENT DOCUMENTS

| | | | |
|---|---|---|---|
| 231673 | 2/1964 | Austria | 52/677 |
| 236085 | 10/1964 | Austria | 52/689 |
| 2534928 | 2/1976 | Fed. Rep. of Germany | 52/687 |
| 2831608 | 1/1980 | Fed. Rep. of Germany | 52/677 |
| 25522 | 6/1963 | German Democratic Rep. | 52/677 |
| 175542 | 6/1961 | Sweden | 52/689 |
| 431000 | 8/1967 | Switzerland | 52/687 |

*Primary Examiner*—Carl D. Friedman
*Assistant Examiner*—R. Chilcott
*Attorney, Agent, or Firm*—Gausewitz, Carr & Rothenberg

[57] ABSTRACT

A spacer device for use in supporting bar-like members in construction applications, the device including a body having a plate portion with a support post portion having a saddle configured on the upper edge thereof, with a plurality of legs affixed to the plate member and extending generally perpendicular thereto. The support post is provided with either an aperture for passing fastening wire therethrough for securing the bar or a pair of aligned openings for receiving a U-shaped clamp member. The plate portion is provided with recesses in alignment with the legs to permit stacking of one spacer atop the other for building layers of rebar framework. The legs may be removable for reverse connection, thus permitting the plate portion to be used as a "sand plate" support for reinforced concrete construction, or alternatively a separate "sand plate" may be used. The plate portions may be secured to strapping at predetermined spacing for facilitating the use thereof, and separate rod members may be attached for maintaining lateral spacing.

12 Claims, 11 Drawing Figures

SPACER FOR CONSTRUCTION USE

BACKGROUND OF THE INVENTION

The background of the invention will be discussed in two parts:

1. Field of the Invention

This invention relates to devices for use in connection with construction, and more particularly to devices for use as spacers for reinforcing rods in reinforced concrete construction.

2. Description of the Prior Art

In construction applications, spacers and retainers are utilized in varying degrees for captively retaining such devices as water and gas tubing as well as wiring cabling or harnesses. In addition, with construction involving reinforced concrete, such as highways, or in the floors, or in the walls of buildings, spacers devices are required for supporting and maintaining reinforcing rods or bars which are positioned in the area where the concrete is to be poured. These rods are sometimes referred to as "rebars". Depending on such parameters as the total surface area and the thickness of the end product of concrete, reinforcement is mandated in varying degrees by builidng codes. One such method of reinforcement involves a steel mesh, while in major concrete construction, such as highways, and for high-rise buildings, reinforcing rods of various diameters, typically one half inch or more, are required. In addition, on such jobs, the reinforcing bars may be positioned in spaced layers due to the thickness of the floor, for example. After the reinforcing bars or latticework is prepared, the concrete is then poured over this framework, which is ultimately embedded within the highway, floor or wall.

By way of example, for a concrete floor on a prepared surface, spacers are needed for providing the vertical separation from the ground, with other spacers connected between layers of rebars. The prepared surface is generally a compacted surface, which may be provided with a layer of compacted sand, with a plastic sheet covering thereon providing a moisture barrier. Spacers are positioned on the prepared surface for supporting the rebars in a plane generally parallel to the prepared surface. Typically, with modern building codes, a spacer is needed every foot of the rebar, with spacing between parallel rebars of about one foot.

Prior art spacers include a pair of generally identically configured rectangular plate members having a height equal to the spacing needed. Each plate includes a longitudinally extending slot of a width generally equal to the width of the plate member. the slots are engaged to form a spacer of cruciform cross-section. One or both of the plates will have at least one hole extending therethrough for receiving a piece of wire which is passed through the hole and about the rebar resting on the spacer, the wire then being twisted to secure the rebar on the spacer.

Some of the difficulties encountered with such spacers involved rusting or decomposition, since the spacers were primarily metallic. In addition with an edge on top of the spacer, such spacers had a tendency to tip after assembly or cock at an angle, thereby defeating the preferable parallel relation of the rebar to the ground or to other rebars at that point of tipping, with consequent loss of strength of the concrete at that location.

Other prior art spacers were formed of plastic, such as of the two piece slotted plate construction, or of a one piece molded construction with the cruciform cross-section. While the problem of rusting was eliminated, the problem of stability and integrity was not.

Accordingly it is an object of the present invention to provide a new and improved spacer for use in construction applications.

It is another object of the present invention to provide a new and improved spacer, particularly adapted for use with reinforcing rods in a single layer or in multiple layers in reinforced concrete construction.

It is a further object of the present invention to provide a new and improved spacer device which may be formed of one piece or a plurality of pieces with a saddle portion for receiving the rebar thereon.

SUMMARY OF THE INVENTION

The foregoing and other objects of the invention are accomplished by providing a spacer including a body having a plate portion with a generally centrally disposed support post portion having a saddle configured on the upper edge thereof, with a plurality of legs affixed adjacent the periphery of the plate member and extending in the opposite direction. The support post is provided with means for securing the rebar after positioning within the saddle portion. The plate portion is provided with recesses in alignment with the legs to permit stacking of one spacer atop the other for building layers of rebar framework. The legs may be removable for reverse connection, thus permitting the plate portion to be used as a "sand plate" support, or alternatively a separate "sand plate" may be used. The plate portions may be secured to strapping at predetermined spacing for facilitating the use thereof.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
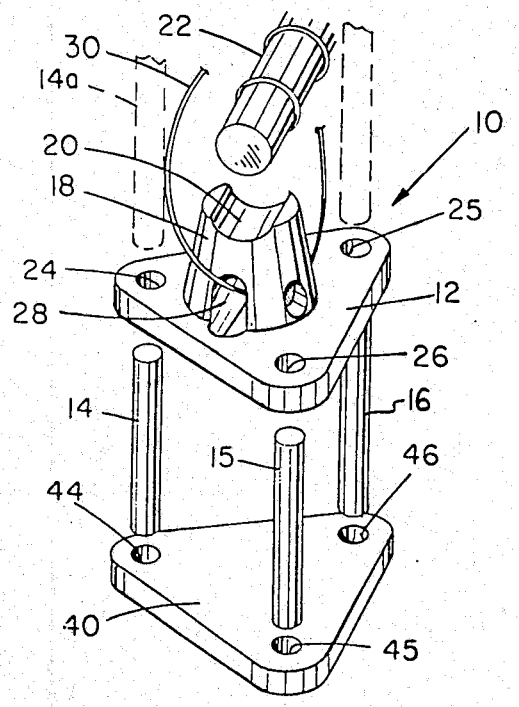
FIG. 1 is an exploded perspective view of the spacer device according to the invention.

Referring now to the drawings, and particularly to FIG. 1, there is shown a spacer device generally designated 10, including a plate portion 12 of triangular configuration, with a plurality of legs 14–16 extending generally perpendicular thereto in a first direction, and a support post 18 extending in the opposite direction, the post 18 being frusto-conical and positioned generally centrally on the plate portion 12 and having a saddle portion 20 formed on the upper surface thereof for receiving the rebar 22 thereon.

Figure 2:
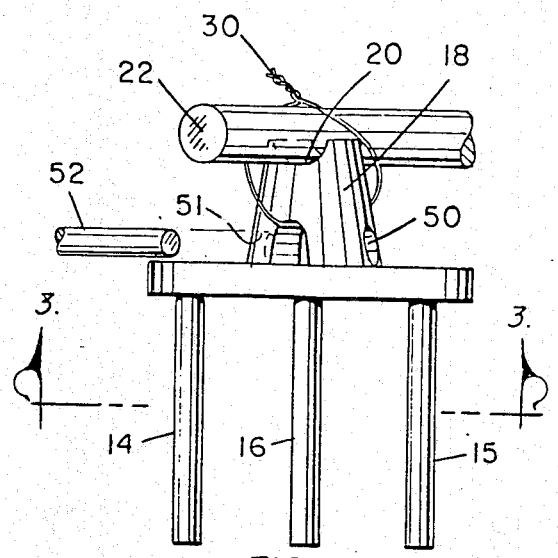
FIG. 2 is a side elevational view of the device of FIG. 1 in assembled relation.
Figure 3:
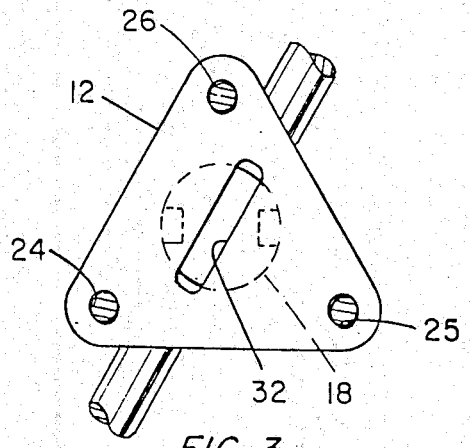
FIG. 3 is a bottom plan view of the device of FIG. 1, partially in cross-section, as viewed along line 3—3 of FIG. 2.

An aperture 28 extends through the post 18 for passage therethrough of suitable fastening means such as a wire 30, which, as shown in FIG. 2, is twisted thereafter to secure the rebar 22 within the saddle portion 20. As shown in FIG. 3, the plate portion 12 is formed as an equilateral triangle with apertures 24–26 at the apexes thereof for receiving the legs 14–16, respectively. In adition, the plate portion 12 has a slot 28 therethrough in alignment with the aperture 28. The slot 28 need not be present and may be omitted. However, for simplification of manufacture, by molding the plate portion 12 and the post 18 as a body or unit, the presence of the slot 32 permits formation of the aperture 28 by molding and provides for use of an uncomplicated mold. With appropriate relief angles, the part may be readily removed from the mold. In the alternative, the plate portion 12 and the post portion 18 may be molded as a unit without the slot 32 by use of retractable rods extending into the mold cavity for forming the aperture 28 with the rods being retracted prior to removing the part from the mold.

Figure 4:
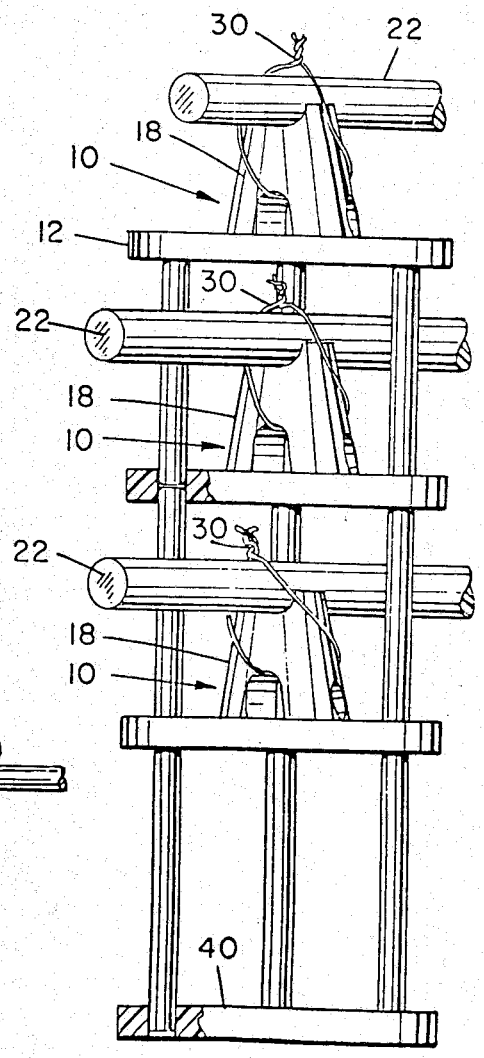
FIG. 4 is a side elevational view of a plurality of the devices in FIG. 1 in stacked relation.

The device 10 is preferably formed of non corroding plastic material, and the leg receiving apertures 24–26 are of a diameter sufficient to permit snug fit of the ends of the legs 14 through 16, with the legs only partially inserted into the apertures. In this way, cup-shaped openings are formed into which the legs of other devices 10 may be inserted for providing a stacked arangement as shown in FIG. 4. In relatively thick roadbed construction and foundations of high rise buildings, the concrete may be one or two or more feet thick. In such instances a layer of rebar framework is effected, with the concrete being poured to a level just exposing the top of the framework, after which another layer of spacers 10 and rebar 22 are assembled into a framework or grid, which is then covered with more poured concrete. A number of layers maybe used, and in all instances, with the leg configuration, as shown, concrete readily flows into the space between the legs 14–16 of the spacer 10.

For the first row or layer of rebar framework, a "sand plate" is required for support on the prepared sand surface without "digging into" the sand upon placing the device 10 on the surface with the rebar 22 thereon. For this purpose a sand plate member 40 may be provided, as shown in FIG. 1, with the shape being generally the same as the plate portion 12, that is an equilateral triangle configuration with apertures 44–46 at the apexes thereof for at least partially receiving therein the legs 14–16, respectively. Alternatively, the sand plate 40 may be omitted, and the legs 14–16 of the device 10 removed and inserted on the opposite side of the plate portion 12, as illustrated by the dotted line representation 14*a* of the leg 14 in FIG. 1. In this application, the legs 14–16 would be on the same side of the plate portion 12 as the post 18, but the post 18 would normally not have a rebar 22 attached thereto, the plate portion 12 of the device 10 simply serving as a support base for the first layer of the framework of rebar 22.

In the erection of such frameworks, it is imperative that the spacing between adjacent spacers 10 be uniform, usually one foot apart. It is additionally imperative that the spacing between layers of rebar 22 be held uniform, from perhaps three to six inches apart.

For maintaining lateral position, by reference to FIG. 2, the post 18 may be provided with recesses 50, 51 shown in dotted lines, the recesses 50 and 51 being countersunk in the sides of the post portion 18 along an axis perpendicular to the axis of the aperture 28. A rod or tool 52 of a predetermined length may be inserted into these recesses 50, 51 and inserted into like recesses in an adjacent device 10 at regular intervals for maintaining lateral spacing between rows of rebar 22.

Figure 5:
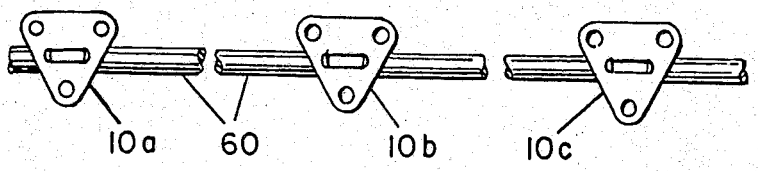
FIG. 5 is a bottom plan view of a string of the spacer devices of FIG. 1 interconnected by a web.

Further, as shown in FIG. 5, a plurality of the devices 10*a*, 10*b*, and 10*c* may be coupled together at equally spaced distances along a strap means or web 60, which may be formed of the same material as part of the fabrication, or may be attached after forming of the devices 10*a*, 10*b*, and 10*c*, such as by heat welding commonly used with plastic parts. The web 60 may conveniently be scribed at equal intervals to serve as a yardstick or the like. With respect to FIG. 5, it is to be understood that alignment holes such as recesses 50 and 51 may be formed in the devices 10*a*, 10*b* and 10*c* for providing means for maintaining lateral spacing with the tool 52.

In accordance with the present invention, the devices 10 may be formed as an integral unit with non-removable legs 14–16 having recesses on the opposite surface of the plate portion 12 for receiving the legs of another device 10 for stacking as shown in FIG. 4. For different vertical spacing requirements, the legs 14–16 may be of different lengths for different devices 10, although all legs of one device will obviously be uniform.

Furthermore, although three legs are shown, two or more may be used, the selection of three legs 14–16 being empirically arrived at as optimum to provide stable support and stacking while providing a minimum of interference for receiving concrete in the space between the legs 14–16, thus maintaining structural integrity. In addition, although the plate portion 12 is shown as triangular, it is to be understood that any convenient geometrical form may be used such as a disc-shaped plate portion, if desired.

Figure 6:
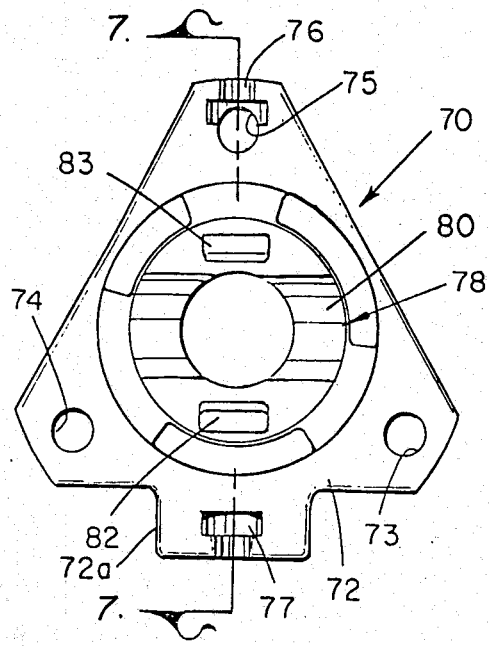
FIG. 6 is a top plan view of an alternate embodiment of the spacer device according to the invention.
Figure 7:
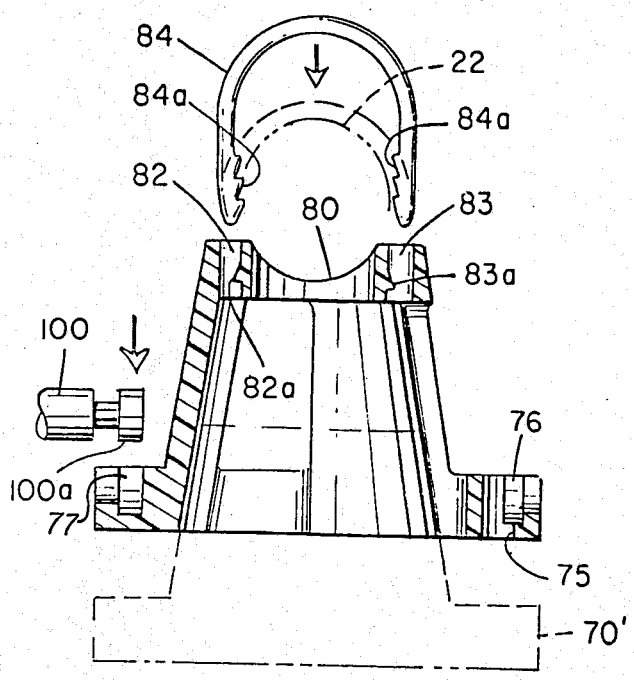
FIG. 7 is a cross-sectional view of the spacer device of FIG. 6 as viewed generally along line 7—7 thereof, illustrating the interconnection of the retainer and lateral spacer bar.
Figure 8:
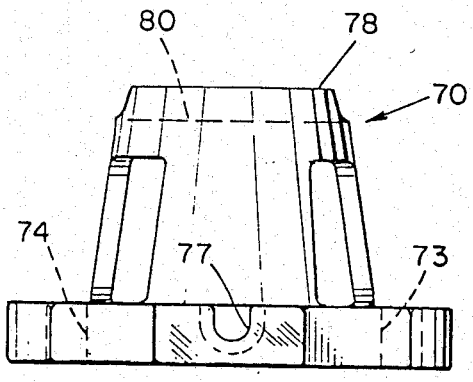
FIG. 8 is a side elevational view of the spacer device of FIG. 6.

Referring now to FIGS. 6 through 8, an alternate embodiment is shown, with spacer 70 being formed as a one-piece frusto-conical configuration with a base portion 72 being generally triangular and having apertures 73–75 extending through the apexes thereof. The interior of the spacer device 70 is generally hollow and similarly frusto-conically configured for enabling stacking of the spacers 70 during packing and shipment as depicted in dotted lines 70′ in FIG. 7. The apertures 73–75 are configured for receiving legs similar to the legs 14–16 heretofore described.

The uppermost portion 78 of spacer 70 includes a saddle portion 80 with a pair of aligned generally parallel axially extending openings 82, 83 having inwardly disposed tangs 82*a*, 83*a* adjacent the lower ends thereof, the tangs being adapted for frictionally engaging the barbed ends 84*a* of a generally U-shaped retainer member 84. As better shown in FIG. 7, the retainer 84 is configured for retaining a rebar 22 within the saddle portion 80 by inserting the barbed ends 84*a* within the openings 82, 83 after positioning the rebar 22 thereon.

Figure 10:
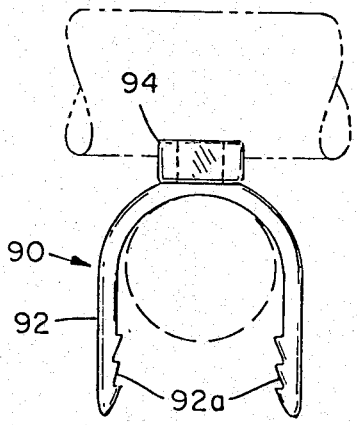
FIG. 10 is a front elevational view of an alternate retainer for use with the device of FIG. 6.
Figure 11:
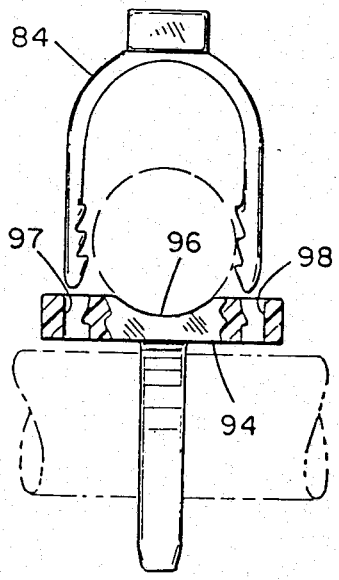
FIG. 11 is a side cross-sectional view of the retainer of FIG. 10 with another like retainer in exploded relation thereto.
Figure 9:
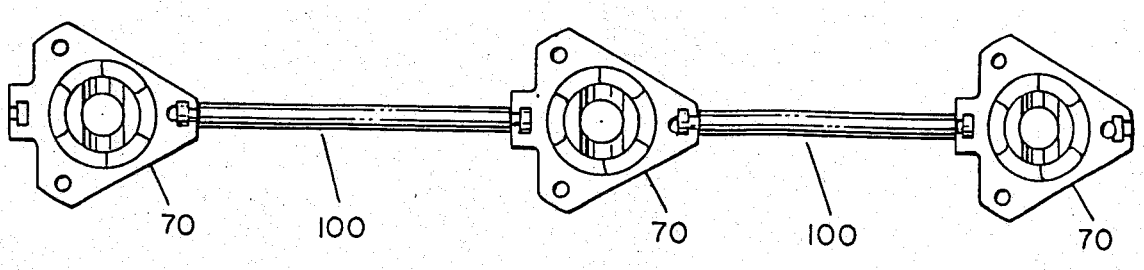
FIG. 9 is a top plan view depicting a plurality of the spacer devices of FIG. 6 in aligned interconnected relation with lateral spacer bars.

FIGS. 10 and 11 depict an alternate retainer member generally designated 90, which is configured for facilitating retention of two rebars 22 in mutually perpendicular stacked relation. To this end, the retainer 90 includes a generally U-shaped portion 92 having barbed ends 92*a* for being captively received within the openings 82 and 83 of the spacer 70. The bight portion has a transversely extending member 92 integrally formed therewith, with a saddle portion 96 at the midpoint thereof. Extending through the ends of the member 94 are aligned generally parallel openings 97, 98 configured generally identically to the openings 82, 83, for receiving therein the barbed ends 84*a* of the retainer 84. With this configuration, the retainer 90 may be utilized with a spacer 70 for securing a first rebar 22 (shown in dotted lines) within the saddle portion 80 thereof, and a mutually perpendicualr rebar 22' (shown in dotted lines) in the saddle portion 96 of the retainer 90 with a retainer 84 securing the second rebar 22' in position.

Referring again to FIGS. 6 through 9, for maintaining the spacers 70 in fixed lateral relation, provision is made in the base 72 of the spacer 70 for receiving the ends of lateral spacing bars 100. For this purpose, the portion of the base 72 adjacent aperture 75 is provided with a generally T-shaped slot, in plan view, extending partially through the base 72 for receiving the matingly configured end 100*a* of the lateral spacer bar 100. In opposite position, the base 72 has a projecting portion 72*a*, with a correspondingly configured slot 77, the projection 72*a* enabling the slots 76 and 77 to be equidistant from the axis of the frusto-concical portion of the spacer 72. The bar 100 is generally circular in cross-section, and, as shown in FIGS. 6 and 7, the bottom of the slots 76 and 77 are semi-circular with the narrow neck portions of the ends 100*a* being retained therein in close fitting relation. An aligned plurality of spacers 70 are shown in FIG. 10 with interconnecting lateral spacer bars 100 maintaining the centers of the spacers 70 equidistant. For ease of manufacture, the spacers 70 and the retainers 84 and 90 are preferably molded of a plastic material with the lateral spacer bars 100 being likewise formed of a plastic rod material which need not be molded.

While the preceding description has concentrated on the use of the spacers 10 and 70 primarily for use with reinforcing rods in concrete construction, it is to be understood that such spacers may be conveniently employed for maintaining other tubular or rod-like members in fixed relation to a surface. For example, pipes or conduit may be retained by the devices described herein with the flange or base portions suitably affixed to a surface, such as by nailing or gluing. In addition, such devices may be conveniently employed for use with electrical cabling or harnesses, with the devices being formed of plastic or other suitable insulating material. The legs may or may not be used for a particular application, as needed.

While there has been shown and described a preferred embodiment, it is to be understood that various other adaptations and modifications may be made within the spirit and scope of the invention.

I claim:

1. In a spacer device for use in construction applications for supporting construction members, such as cabling, tubular members, bar-like members, or rod-like members relative to a supporting surface, the combination comprising:

body means having saddle means for receiving a construction member at least partially thereon, said body means including a plate portion and a support post portion thereon with said saddle means formed in a surface of said post portion generally parallel to said plate portion, said plate portion having an enlarged surface area;

a pair of openings formed in said post portion, said openings including tang means formed therein;

a separable generally U-shaped clamp member having barbed ends insertable into said openings for engagement with said tang means for fastening of the construction member within said saddle means; and other means secured to said body means for spacing said device from a supporting structure.

2. The combination according to claim 1 wherein said other means includes leg means and said device further includes means on said body means for coacting with the leg means of another such device for enabling formation of a stacked spaced arrangement of such devices and the construction members supported thereby.

3. The combination according to claim 1 wherein said body means including said plate portion, said support post portion and said saddle means are formed as a unitary member.

4. The combination according to claim 3 wherein said other means includes a plurality of integrally formed leg members adjacent the periphery of said plate portion extending in a direction generally perpendicular to said plate portion.

5. The combination according to claim 4 wherein said plate portion is generally triangular and said post portion is a generally frusto-conical portion positioned generally centrally on said plate portion.

6. In a spacer device for use in construction applications for supporting construction members, such as cabling, tubular members, bar-like members, or rod-like members relative to a supporting surface, the combination comprising:

a unitary body member having a plate portion and a generally centrally positioned generally hollow frusto-conically configured post portion with a surface generally parallel to said plate portion, said plate portion having a surface area greater than the adjacent portion of said post portion;

saddle means formed in post portion surface for receiving a construction member at least partially thereon;

a separable generally U-shaped clamp member having barbed ends; and means on said post portion including a pair of spaced openings having tangs fomred therein, said openings being formed in said post portion surface and aligned for receiving the ends of said clamp member therein for securing the construction member to said post portion at least partially within said saddle means.

7. The combination according to claim 6 wherein said device further includes means on said plate portion for receiving lateral spacing members connectable to other such devices for maintaining a given distance between adjacent such devices.

8. The combination according to claim 6 further including leg means secured to said plate portion for spacing said device from a supporting surface.

9. A spacer device for use in construction applications for supporting construction members, such as rod-like concrete reinforcing members, or tubular members, relative to a supporting surface, the combination comprising:

a unitary body member having a frusto-conically configured body portion, a plate portion having a surface area larger than the larger end of said body portion, a surface on the other end of said body portion generally parallel to said plate portion, said surface having a saddle formed therein for receiving a construction member at least partially thereon, and a pair of openings in said surface, said openings being in spaced relation with said saddle, with one opening on each side of said saddle, each of said openings having tangs formed therein; and a separable clamp member having a generally U-shaped portion wiht barbed ends configured and aligned for detenting enagement with the tangs of said openings for securing the construction member to said body members at least partially within said saddle.

10. The combination according to claim 9 wherein said body portion is generally hollow and said openings are formed in the axial direction of said body portion.

11. The combination according to claim 9 wherein said device further includes means on said plate portion for receiving lateral spacing members connectable to other such devices for maintaining a given distance between adjacent such devices.

12. The combination according to claim 9 wherein said unitary body member and said clamp member are formed from a generally rigid plastic material.

* * * * *